US012006002B2

(12) United States Patent
Wood

(10) Patent No.: US 12,006,002 B2
(45) Date of Patent: Jun. 11, 2024

(54) TOOLLESS FIN MOUNT ASSEMBLY

(71) Applicant: DYNAMIK Pty Limited, Fairfield (AU)

(72) Inventor: David Wood, Fairfield (AU)

(73) Assignee: DYNAMIK PTY Limited, Fairfield (AU)

( * ) Notice: Subject to any disclaimer, the term of this patent is extended or adjusted under 35 U.S.C. 154(b) by 415 days.

(21) Appl. No.: 17/381,039

(22) Filed: Jul. 20, 2021

(65) Prior Publication Data

US 2021/0347446 A1 Nov. 11, 2021

Related U.S. Application Data

(63) Continuation-in-part of application No. PCT/AU2020/000009, filed on Jan. 21, 2020.

(51) Int. Cl.

| | |
|---|---|
| ***B63B 32/66*** | (2020.01) |
| ***B63B 1/00*** | (2006.01) |
| ***B63B 32/64*** | (2020.01) |

(52) U.S. Cl.

CPC ..... *B63B 32/66* (2020.02); *B63B 1/00* (2013.01); *B63B 32/64* (2020.02)

(58) Field of Classification Search

CPC ..... B63B 32/00; B63B 32/66; B63B 1/00; B63B 32/64

USPC ..... 441/79

See application file for complete search history.

(56) References Cited

U.S. PATENT DOCUMENTS

| | | | | |
|---|---|---|---|---|
| 6,991,504 | B1 | 1/2006 | English et al. | |
| 7,264,524 | B2 | 9/2007 | Batt | |
| 8,393,928 | B2 * | 3/2013 | Kumano | B63B 32/66 441/79 |
| 9,862,467 | B2 | 1/2018 | Norrie et al. | |
| 2016/0144933 | A1 * | 5/2016 | Kumano | B63B 32/66 441/79 |

FOREIGN PATENT DOCUMENTS

| | | | |
|---|---|---|---|
| AU | 2017100537 | A4 | 6/2017 |
| WO | 2008156603 | A1 | 12/2008 |
| WO | 2017045011 | A1 | 3/2017 |

* cited by examiner

*Primary Examiner* — Lars A Olson

(74) *Attorney, Agent, or Firm* — Craft Chu PLLC; Andrew W. Chu

(57) ABSTRACT

An assembly includes a fin and a fin mounting box for a water sports board. The mounting box is mounted to the board and has an outwardly facing channel formed therein. The fin includes a fin base and a body extending from the base. The fin base is shaped to be received in the channel. The channel includes channel engagement formations, and the fin base includes corresponding fin base engagement formations which engage the channel engagement formations when the fin base is inserted into the channel so as to retain the fin to the mounting box. The assembly includes a locking tab received in the channel to prevent movement of the fin base in the channel and disengagement of the corresponding channel and fin base engagement formations.

17 Claims, 9 Drawing Sheets

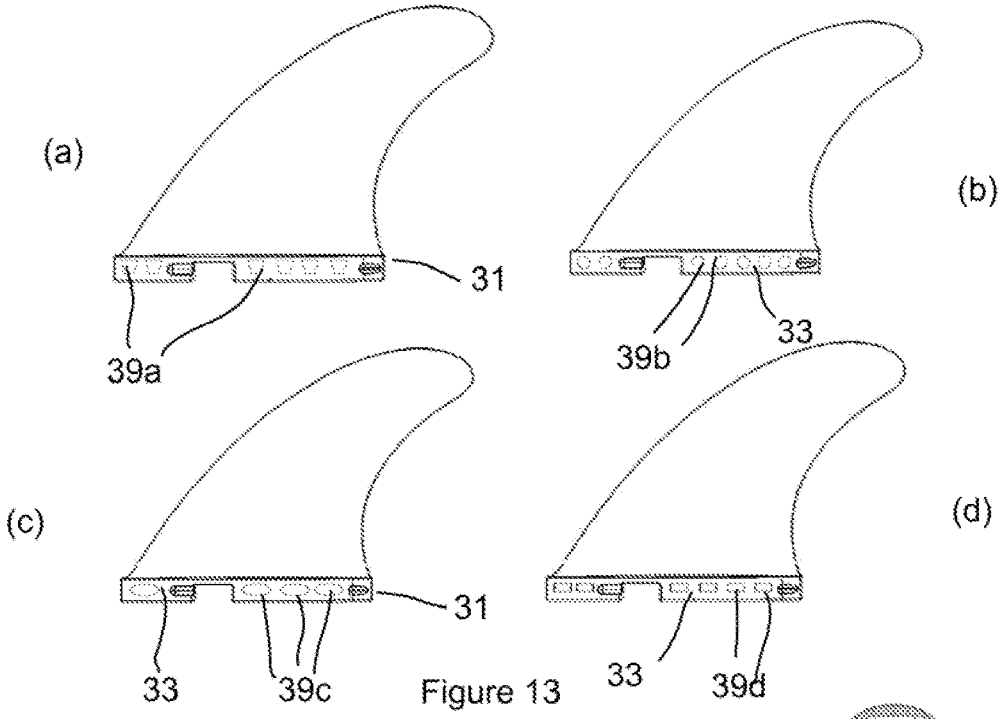
Figure 13
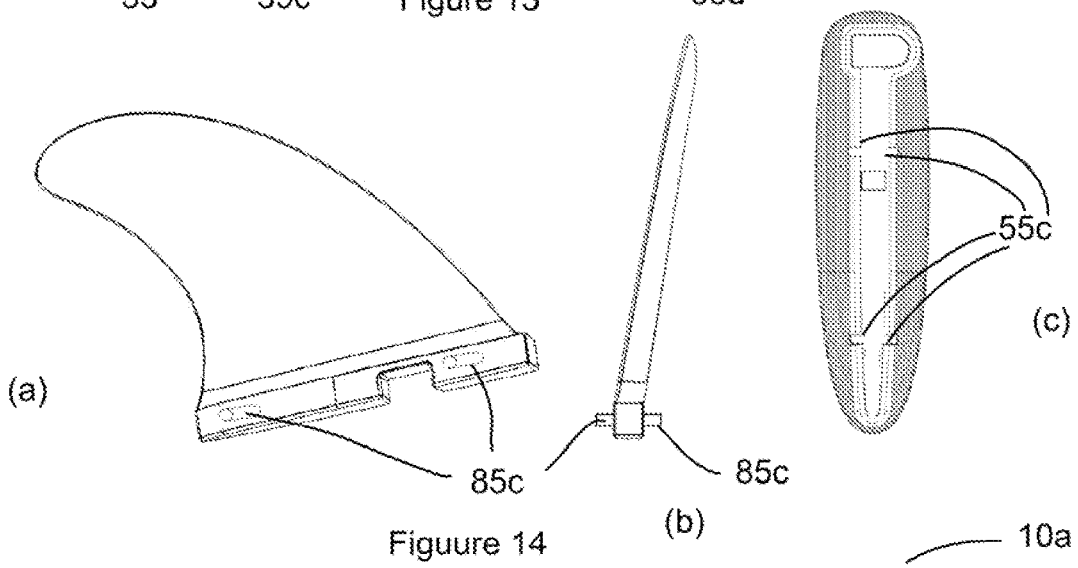
Figuure 14
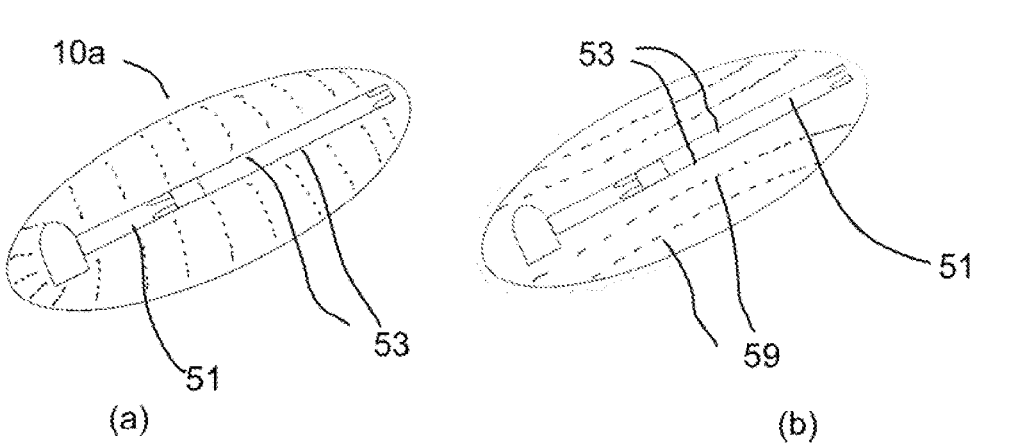
Figure 15

TOOLLESS FIN MOUNT ASSEMBLY

CROSS-REFERENCE TO RELATED APPLICATIONS

The present application claims priority under 35 U.S.C. Section 120 from U.S. Patent Application Serial No. PCT/AU20/00009, filed on 21 Jan. 2020, entitled "TOOLLESS FIN MOUNT ASSEMBLY". See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a toolless fin mount assembly for a surface water sports board. The example provided below refers to a surfboard. The invention is however useful for other surface water sports boards that use a fin such as stand-up paddle boards and windsurfing boards.

The invention can also be used for attachment of fins in other removable fin applications such as underwater devices and watercrafts.

2. Description of Related Art Including Information Disclosed Under 37 CFR 1.97 and 37 CFR 1.98

Presently, fins for surfboards and other boards are mounted using a tool such as a fin key or a screwdriver. A fin key is essentially a 3/32 inch Allen key or similar size.

The board comprises a mounting box which is built into or attached to the board, the mounting box having a channel exposed at a lower surface of the board. The fin comprises a formation which is received in the channel, and fasteners such as screws are used and tightened via a fin key to retain the fin to the mounting box.

The difficulty with present systems is that the mounting and removal of fins requires a tool which is often lost or misplaced, and the use of threaded screws often leads to screw threads being stripped.

There are fin attachment systems that are toolless. However, considerable force is required in these systems to remove the fin from the board/watercraft thus causing possible damage to the board/watercraft or the fin and possibly injuring the individual.

The present invention seeks to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY OF THE INVENTION

According to a first aspect the present invention provides an assembly comprising a fin and a fin mounting box for a water sports board, wherein:

- the mounting box is adapted to be mounted to the board, the mounting box having an outwardly facing channel formed therein,
- the fin comprises a fin base and a body extending from the base, the fin base being shaped to be received in the channel,
- the channel comprises channel engagement formations and the fin base comprises corresponding fin base engagement formations which engage the channel engagement formations when the fin base is inserted into the channel to retain the fin to the mounting box, and
- the assembly includes a locking tab received in the channel to prevent movement of the fin base in the channel and disengagement of the corresponding channel and fin base engagement formations.

In a preferred embodiment, the mounting box comprises an elongated body having a first end and a second end, the channel being formed in the body to extend from the first end to the second end, and the channel comprises a fin section and a lock section, the lock section being disposed adjacent the first end and the fin section extending from the lock section towards the second end, the fin section adapted to receive the fin base and the lock section adapted to receive the locking tab.

In another preferred embodiment, the channel engagement formations comprises:

- at least one retention means pair of a retention protrusion extending from an internal side wall of the mounting box channel and a biased button head extending from an opposite facing internal side wall of the mounting box channel, the biased button head disposed opposite to and spaced from the retention protrusion.

In another preferred embodiment, the channel engagement formations comprises two pairs of retention means, a first pair being adjacent the second end and a second pair being at a mid-portion of the channel.

In another preferred embodiment, the button head of the first pair of retention means is disposed on a first internal side wall and the button head of the second pair of retention means is disposed on an opposite second internal side wall.

In another preferred embodiment, each button head comprises a mounting arm which extends laterally from the button head, a distal end of the mounting arm is mounted to the mounting box to provide a cantilever mounting for the button head, and a biasing spring is disposed behind the button head to bias the button head.

In another preferred embodiment, each button head extends via an opening in the internal side wall into the channel.

In another preferred embodiment, the fin base engagement means comprises a respective recess in a side wall of the fin base to receive each retention protrusion of the mounting box channel, and at the opposite side wall of the fin base to each recess, the side wall of the fin base does not have any recesses and provides a flat wall surface for the button heads.

In another preferred embodiment, the fin base comprises a first recess in a side wall of the fin base formed adjacent the second end and a second recess formed in an opposite side wall of the fin base at a mid-portion thereof.

In another preferred embodiment, the fin base is moved in the rearward longitudinal direction to engage the fin base engagement formations with the channel engagement formations, and the fin base is moved in the forward longitudinal direction to disengage the fin base engagement formations from the channel engagement formations.

In another preferred embodiment, the locking tab is pivotable between a lock position and an unlock position, wherein in the lock position the locking tab prevents movement of the fin base within the channel and in the unlock position the fin base can be removed from the channel.

In another preferred embodiment, the lock section is dimensioned and disposed such that the locking tab in the lock position thereof extends fully across and covers a start entry of the fin section.

In another preferred embodiment, the lock section comprises a pivot portion with pivot protrusions to provide pivotal mounting of the locking tab between lock and unlock positions thereof, and a retention portion with retention protrusions or a retention magnet for locking the locking tab in the closed position thereof.

In another preferred embodiment, the pivot protrusions are disposed close to the start entry of the fin section such that a proximal end of the locking tab can be pushed into the pivot portion to move the locking tab into the unlock position thereof.

In another preferred embodiment, the locking tab urges the fin base to where the corresponding engagement means engage each other in the lock position thereof.

In another preferred embodiment, the mounting box is adapted to be mounted onto the lower surface of the board where it extends from the lower surface of the board, the mounting box comprising a body having a flat upper surface to be attached to the surface of the watercraft board and a lower surface which is bulbous convex shaped and extending from the lower surface.

In another preferred embodiment, the channel engagement formations comprise retention protrusions extending from facing internal side walls of the mounting box channel and the corresponding fin base engagement formations comprises grooves formed in the fin base, the protrusions shaped to be received in the corresponding grooves in the fin base.

In another preferred embodiment, the protrusions comprise a first pair of protrusions formed adjacent the second end and a second pair of protrusions formed at a mid-portion of the channel of the fin section, and the fin base comprises a first pair of grooves formed adjacent the second end and a second pair of grooves formed at a mid-portion thereof.

In another aspect, the invention provides a removable fin for a fin mounting box of a sports board, the mounting box having an outwardly facing channel formed therein which comprises channel engagement formations, the channel engagement formations comprising:

at least one retention means pair of a retention protrusion extending from an internal side wall of the mounting box channel and a biased button head extending from an opposite facing internal side wall of the mounting box channel, the biased button head disposed opposite to and spaced from the retention protrusion, the fin comprising a fin base and a body extending from the base, wherein the fin base comprises engagement means being a respective recess in a side wall of the fin base to receive each retention protrusion of the mounting box channel, and at an opposite side wall of the fin base to each recess, the side wall of the fin base does not have any recesses and provides a flat wall surface for the button heads.

Preferably, the channel engagement formations comprise two pairs of retention means, a first pair being adjacent the second end and a second pair being at a mid-portion of the channel, with the retention protrusion and the biased button head of the second pair being on respective opposite internal walls to the retention protrusion and the biased button head of the first pair, the fin base comprising a first recess in a side wall of the fin base formed adjacent a rear end thereof and a second recess formed in an opposite side wall of the fin base at a mid-portion thereof. Preferably, the mounting box is adapted to be mounted into the board to be flush with a lower surface of the board with the channel exposed.

Preferably, the fin comprises fairing between the base and the fin body for hydrodynamic effect.

In another embodiment, the locking tab is actuatable by hand.

In another embodiment, in the lock position, the locking tab is flush with a lower surface of the mounting box.

Other aspects of the invention are also disclosed.

BRIEF DESCRIPTION OF THE SEVERAL VIEWS OF THE DRAWINGS

Notwithstanding any other forms which may fall within the scope of the present invention, preferred embodiments of the present invention will now be described, by way of examples only, with reference to the accompanying drawings in which:

FIG. 14 shows a different embodiment of the corresponding engagement means where (a) and (b) shows the fin base having outward protrusions to be received in (c) recesses in the mounting box, FIG. 15 shows a modification of the mounting box of FIG. 7 with the recess having parallel internal walls and (b) showing flutes or hydro dynamic contours applied to the upper surface

DETAILED DESCRIPTION OF THE INVENTION

Figure 1:
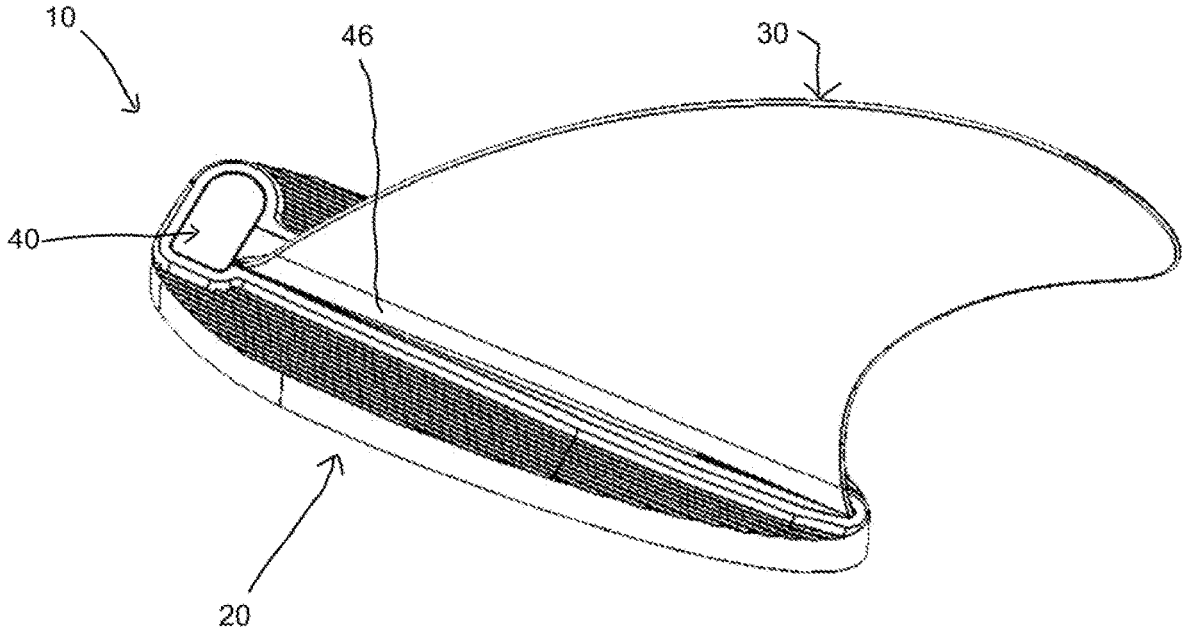
FIG. 1 is a perspective view of a fin and mounting box assembly according to a preferred embodiment of the present invention.

It should be noted in the following description that like or the same reference numerals in different embodiments denote the same or similar features.

FIG. 1 is a perspective view of a fin mount assembly 10 according to a preferred embodiment of the present invention. The assembly 10 comprises a mounting box 20, a fin 30 and a locking tab 40.

The mounting box 20 is adapted to be mounted into a surfboard or other water sports board, such that it is flush with the lower surface of the board.

Figure 2:
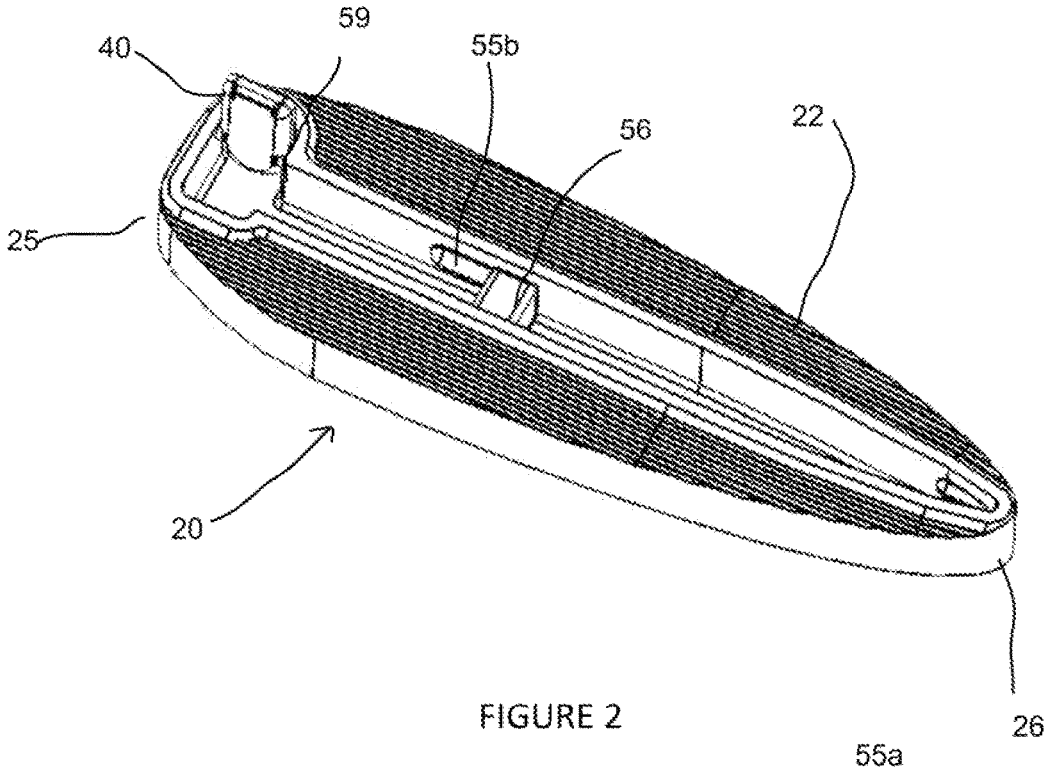
FIG. 2 is a perspective view of the mounting box with the locking tab in the open position.
Figure 3:
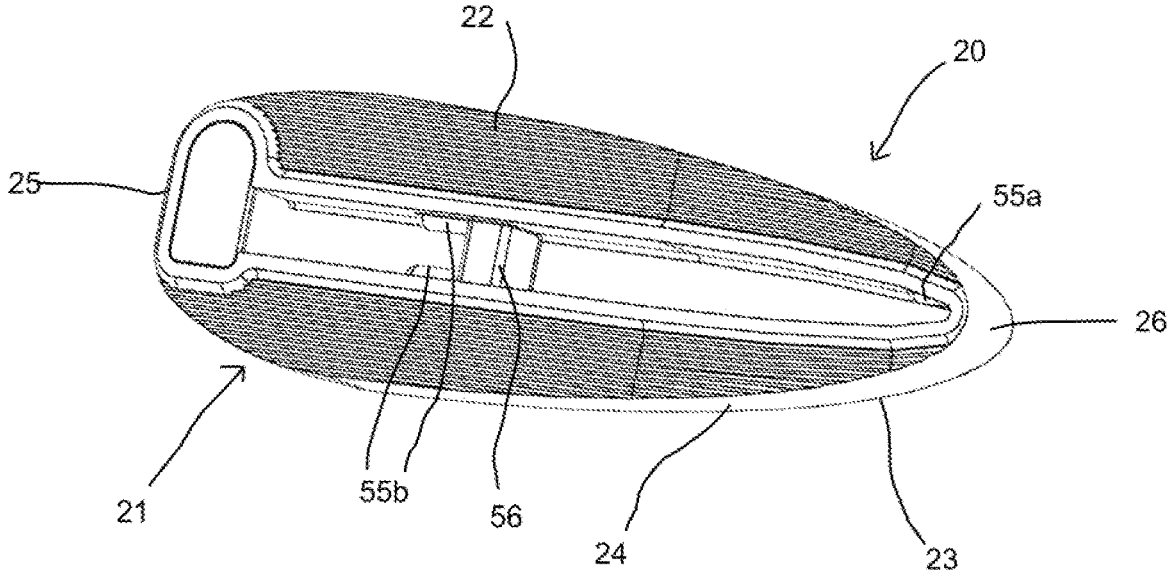
FIG. 3 is a perspective view of the mounting box with the locking tab in the closed position.
Figure 4:
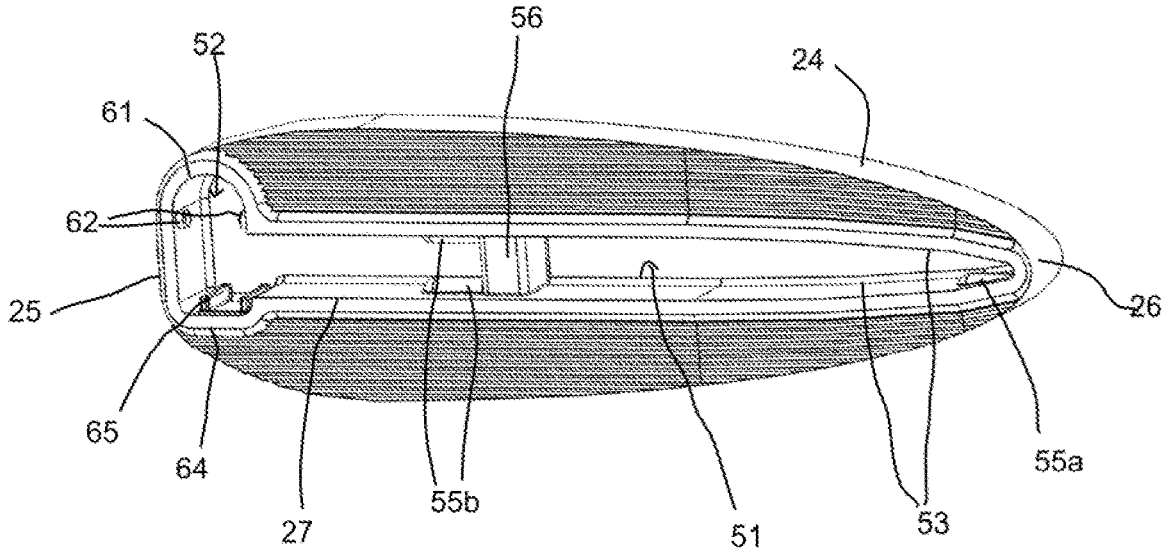
FIG. 4 is a perspective view of the mounting box without the locking tab.

Referring to FIGS. 2 to 4, the mounting box 20 comprises an elongated body 21 having a first (lower) surface 22, an opposite second (upper) surface 23, peripheral side edge 24, a first end 25 and a second end 26. The body 21 is of a predetermined thickness between the first surface 22 and the second surface 23, with the side edge 24 extending between the surfaces 22 and 23.

A channel 27 is formed in the body 21, the channel 27 formed in the lower surface 22 and extending from the first end 25 to the second end 26. The channel 27 comprises a fin section 51 and a lock section 52. The lock section 52 is disposed adjacent the first end 25. The fin section 51 extends from the lock section 52 towards the second end 26. The fin section 51 is shaped for receiving a correspondingly shaped base 31 of the fin 30.

The fin section 51 of the channel 27 is generally tapered from the first end 25 to the second end 26, having internal side walls 53 that gradually converge or are curved towards each other. The fin section 51 thus gets narrower from the first end 25 to the second end 26.

The fin section 51 comprises retention protrusions 55 formed therein which are shaped to be received in corresponding recesses, slots or grooves 85 in the base 31 of the fin 30. The protrusions 55 comprise a first pair 55*a* of bulbous protrusions formed adjacent the second end 26 and a second pair 55*b* of bulbous protrusions spaced from the first pair 55*a*, formed closer to but spaced from the first end 25. The first and second pairs of protrusions 55 extend from the facing internal side walls 53 of the fin section 51. A bridge protrusion 56 extends between the internal side walls 53 adjacent the second pair 55*b*, the bridge protrusion 56 acting as reinforcement and as a locator for the fin 30.

The lock section 52 is an enlarged continuation of the channel 27 at the first end 25. The lock section 52 extends from a start entry 59 of the fin section 51, and has a length extending perpendicular to the longitudinal direction of the fin section 51. The lock section 52 is shaped to receive the locking tab 40 therein and provide pivotal mounting of the locking tab 40 as well as to lock the locking tab 40 therewithin. The lock section 52 is dimensioned and oriented such that the locking tab 40 in use extends fully across and covers the start entry 59 of the fin section 51.

The lock section 52 comprises a pivot portion 61 which extends laterally outward relative to one side wall 53 of the fin section 51, and a retention portion 64 adjacent the opposite side wall 53 of the fin section 51. The pivot portion 61 comprises pivot protrusions 62 extending from opposing internal walls thereof which provide the pivot mounts for the locking tab 40. The retention portion 64 comprises retention protrusions 65 for locking the locking tab 40 in the closed position thereof.

The pivot protrusions 62 are disposed close to the start entry 59 of the fin section 51, such that an end of the locking tab 40 can be pushed into the pivot portion 61 to move the locking tab 40 into the unlocked position thereof.

Figure 5:
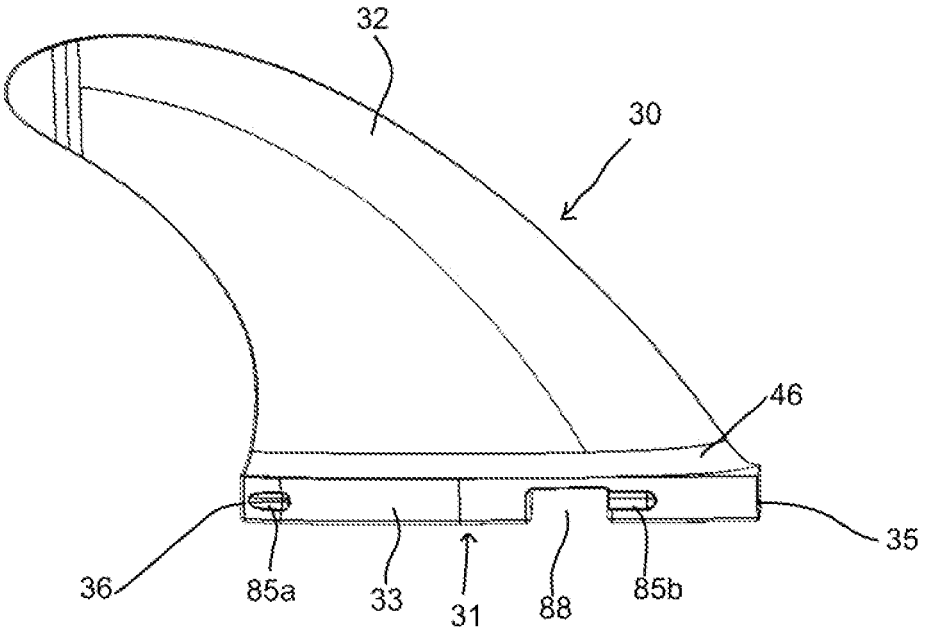
FIG. 5 is a side view of the fin.

Referring to FIG. 5, the fin 30 comprises a base 31 and a shaped body 32. The body 32 is shaped as desired to provide the desired fin performance. The base 31 is shaped and dimensioned to correspond to and be received in the fin section 51 of the mounting box channel 27. The base 31 is thus shaped to be elongated from a first end 35 to a second end 36 thereof and have external side walls 33 that gradually converge or are curved towards each other from the first end 35 to the second end 36, corresponding to the internal side walls 53 of the fin section 51. The base 31 thus gets narrower from the first end 35 to the second end 36.

The base 31 comprises recesses 85 which correspond to the protrusions 55 of the fin section 51. The recesses 85 comprise a first pair 85*a* formed adjacent the second end 36 and a second pair 85*b* formed adjacent but spaced from the first end 35. The first and second pairs of recesses 85 are formed into the side walls 33. A cavity 88 extends between the side walls 33 adjacent the second pair 85*b*, the cavity 88 receiving the bridge protrusion 56 in use. Additional weight saving or design cut-outs or cavities can be formed in the base 31 to extend between the side walls 33. Such cut-outs or cavities can be square, triangular, circular, oval or other shape cross-section as desired as shown in FIG. 13.

Figure 6:
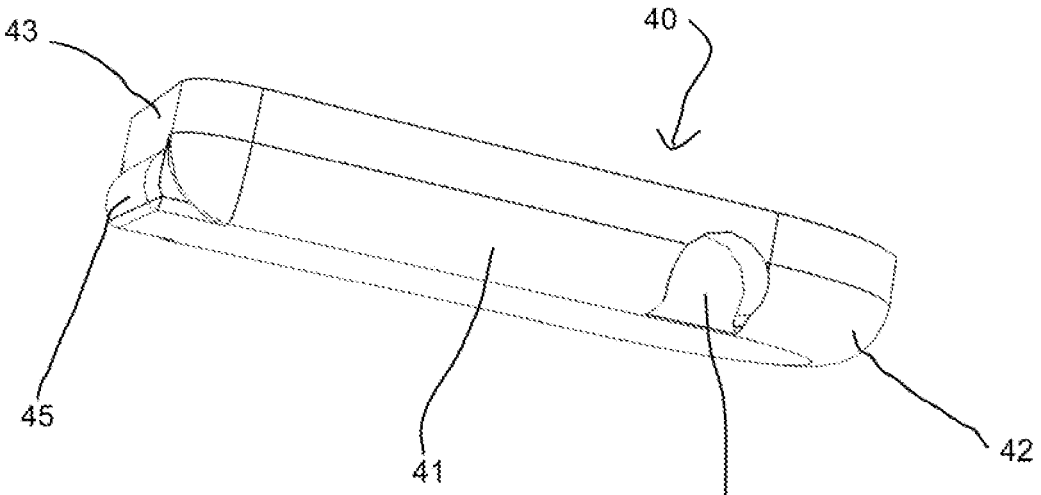
FIG. 6 is a bottom perspective view of the locking tab.

The locking tab 40 as shown in FIG. 6 comprises a body 41 which is shaped and dimensioned to be fully received in the lock section 52 of the mounting box channel 27 and to fully cover the lock section 52 in the closed position thereof. The body 41 comprises a proximal end 42 and a distal end 43. The body 41 includes mount recesses 44 at opposing side walls thereof adjacent but spaced from the proximal end 42 and a retention protrusion 45 at the distal end 43 thereof. The mount recesses 44 receive the pivot protrusions 62 and the retention protrusion 45 engages the retention protrusions 65 in use.

As shown in FIG. 2, The locking tab 40 is pivotable by hand (use of a user's fingers pressing on the proximal end 42) to its unlock position, at which proximal end 42 is received in the lock section 52 and the locking tab 40 does not impede with the start entry 59 of the fin section 51 adjacent the first end 25.

As shown in FIGS. 1 and 3, The locking tab 40 is pivotable to its lock position by hand (use of a user's fingers), at which the locking tab 40 extends across the start entry 59 of the fin section 51.

In use, the first end 25 is designated as the front end and the second end 26 is designated as the rear end. The mounting box 20 is mounted into a surfboard or other water sports board, such that the first surface 22 thereof is flush with the lower surface of the board. To mount the fin 30, the locking tab 40 is moved to its unlock position. The base 31 of the fin 30 is inserted into the channel 27 with the recesses 85 slightly forward of the respective protrusions 55. The bridge protrusion 56 is received in the cavity 88. The base 31 is then moved rearwardly (slid rearwards) such that the protrusions 55 are received or inserted in the recesses 85 which retains the fin 30 to the mounting box 20.

The base 31 and channel 27 are dimensioned to provide a generally tight fit therebetween, and the front end 35 of the base 31 terminates at the start 59 of the fin section 51. The converging external side walls 33 of the base 32 engaging the converging internal side walls 53 of the channel 27 to contribute to the tight fit. When the locking tab 40 is moved to its lock position, the locking tab 40 extends across the start entry 59 and prevents forward movement of the fin 30 which can lead to its removal from the mounting box 20. The locking tab 40 in the locked position is flush with the lower surface 22 of the mounting box 20, and thus flush with a lower surface of the board. The locking tab 40 can also engage and even urge the base 31 rearwardly in the lock position to assist in retaining the fin 30 to the mounting box 20.

The present example thus provides laterally actuated bridge button, actuatable by hand (without tools), for locking a fin to a mounting box of a surfboard. The surfboard fin system requires no fixing elements or fasteners screwed into the fin body to stop the fin coming out of the surfboard or watercraft.

The fin is placed into a receiving opening receptacle in the front portion of the fin box forward initially and the fin base is totally placed within the fin box and no part of the fin base is residing on the surfboard laminar surface or extending therefrom.

The fin is then brought back to engage into two rear and two forward bulbous protrusions which extend outwards within the box receptacle, the fin body engages till it cannot go any further back and hits the box inside end wall. These protrusions marry with rebates on the fin base at either side thereof, at forward and rear positions along the fin base.

Once they are pulled back into place they stop the fin from moving upwards and backwards therefore securing the fin into the watercraft firmly and securely. Once the fin is in the precise position the lateral bridge button is simply pipped off laterally and therefore simply stopping the fin moving in any forward motion. This securely stops the fin of any movement forward.

The lateral bridge button is pushed down on the right hand side which makes the clip button lift like a bridge and doing so levers the button upwards creating an open passage for the fin to then be removed as many times as is required for the fin to be installed or removed from the surfboard fin box.

The lateral bridge button engages into two pips in the right hand side of the fin box at front portion which creates a pivoting axle for the button and connects the lateral bridge button into the fin box securely. The left hand side of the button has a parallel lateral pip which engages the button to be secure laterally and stops it from lifting upwards.

The button can then be pressed on the right hand side and the button then disengages from the left hand side pip within the fin box the bridge button goes up and allows the fin body to move forward and removal of the fin is possible. The bridge acts as a stopper only of the fin body moving forward.

The lateral bridge button is set just below the unsanded upper fin box top surface and once the surfboard is fibre glassed. The box is sanded down and the lateral bridge button sands down to the same surfboard bottom surface to give a exact flat finish and therefore not hindering the laminar/water flow in anyway.

The example in one embodiment is designed to be installed before the fibreglass is applied to the surfboard, thus giving a superior bond to the surfcraft.

The lateral bridge button stops the fin body from moving forward and also once the button is pressed upwards it allows the fin to be removed by pulling forward out of the bulbous horizontal protrusions which in combination stop the fin coming out. The button acts simply as a stopper only it does not connect or fasten the fin body in a fastening or tensioned way.

The bulbous horizontal protrusions allow the fin to securely be engaged to the fin box without lift and minimizes lateral movement.

A fin with bulbous horizontal rebates and having a fairing around the lower base portion. These fairing around the fin body base creates a hydrodynamic effect with creating less drag and turbulence.

The lateral bridge button having rebates that engage with the fin box horizontal pylons creating an axle for the button to rotate within the box.

The Toolless fin mount system is installed before the laminating process which gives the fin box superior bond with the fiberglass.

The embodiment provides a simple bridged pivotal button tab which allows easy access for the fin to be removed from the fin box and provides an easy passage for fin removal without resulting in possibly damaging the watercraft under surface.

The fin body is stopped moving forward due to the pivotal bridge button which extends across the opening of the mounting box channel. The button rotates beyond 90 degrees which unblocks the channel to allow easy passage for the fin to be removed from the fin box. The button can be located front or rear or side of the fin box and in combination with the bulbous protrusions creates a solid fin mount.

The fin combines around the base portion a fairing 46 specifically around the base of each fin inside edge and outside edge. The fairing 46 creates less drag and turbulence when watercraft is in motion and creates a seamless connection to the watercraft surface with fin body and watercraft surface.

Although a preferred embodiment of the present invention has been described, it will be apparent to skilled persons that modifications can be made to the embodiment shown.

For example, the orientation of the mounting box can be amended, with the locking tab located at the rear end. In this embodiment, the fin base is moved forwardly for locking with the channel engagement means and then rearwardly to remove from the channel. The invention can also have two locking tabs—one at the front and one at the rear. The locking tab button can alternatively be mounted longitudinally and can be positioned at the front and rear of the box or middle/sides thereof.

The inner sidewall box protrusions 55 can be shaped in a variety of suitable shapes ways—dovetail, vee shaped, rectangular, etc.

The pivoting locking tab button can be made bigger and be positioned in numerous locations rear, side, etc.

The button can also be replaced with a magnet or a block style piece fulfilling the same desired stopping action of the fin body.

Other corresponding engagement and retention means between the base and the channel are possible, including prism shaped protrusions and slots/channels.

Figure 7:
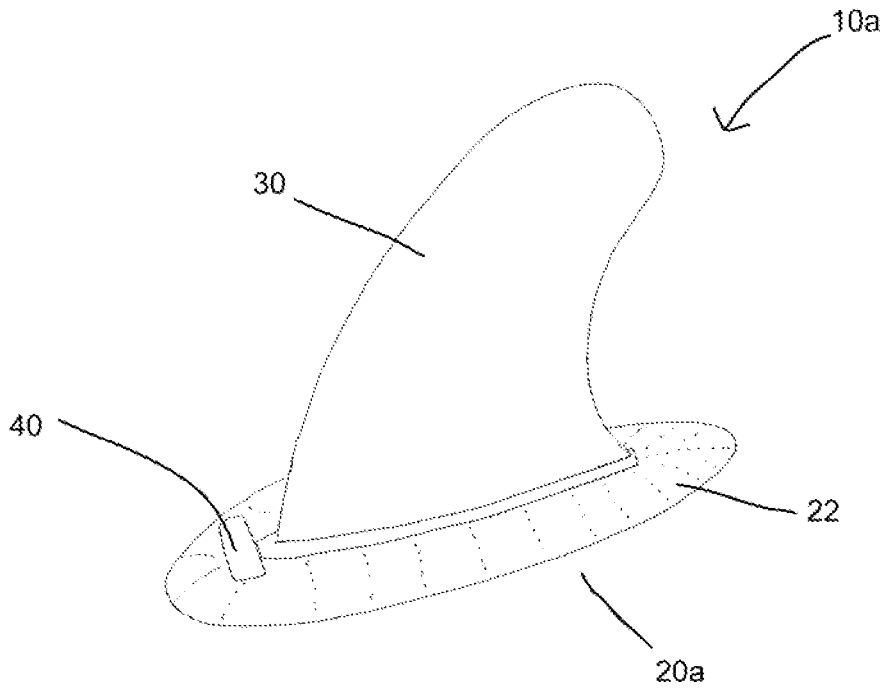
FIG. 7 is a perspective view of a fin and mounting box assembly according to another preferred embodiment of the present invention.
Figure 8:
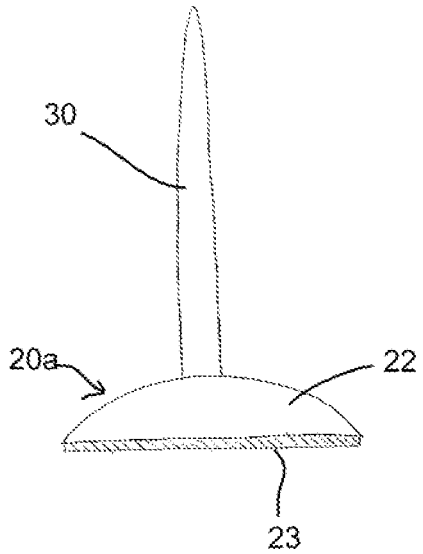
FIG. 8 is a front view of the assembly of FIG. 7.
Figure 9:
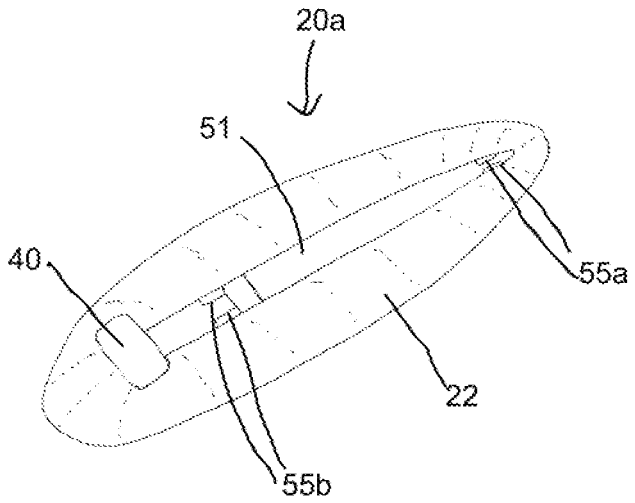
FIG. 9 is a perspective view of the mounting box of FIG. 7

FIGS. 7 to 9 show a fin mount assembly 10*a* according to another preferred embodiment of the present invention. The assembly 10*a* is similar to the assembly 1 above and similar parts are referred to with similar numerals. The assembly 10*a* also comprises a mounting box 20*a*, a fin 30 and a locking tab 40.

The mounting box 20*a* in this embodiment is adapted to be mounted onto the lower surface of the board. In other words, the mounting box 20*a* is not built-in into the board, it extends from the lower surface of the board.

The mounting box 20*a* comprises a body 21 having a flat upper surface 23 and a lower surface 22 which is bulbous convex shaped from the upper surface 23. The channel 27 with the fin section 51 and the lock section 52 for the locking tab 40 are formed to extend from the lower surface 22. The fin section 51 similarly comprises the protrusions 55 formed in the converging internal side walls 53. The upper surface 23 is attached to the lower surface of the watercraft board after the manufacturing process has finished. The upper surface 23 is attached via adhesive tape, glue, resin, or any other suitable adhesive.

This eliminates the need to install a fin box into the watercraft before the manufacturing stage or during it. The surfboard can be made without any fin systems and the fin mount assembly 10*a* can be applied by simple adhesive means to the undersurface of any watercraft, forming a complete embodiment of fin and assembly which creates a complete fin system.

The bulbous convex shaped body also acts to optimise the waterflow thus creating less drag between the fin body and laminar board surface area. This creates less turbulence for the watercraft resulting in more speed and lift.

Figure 10:
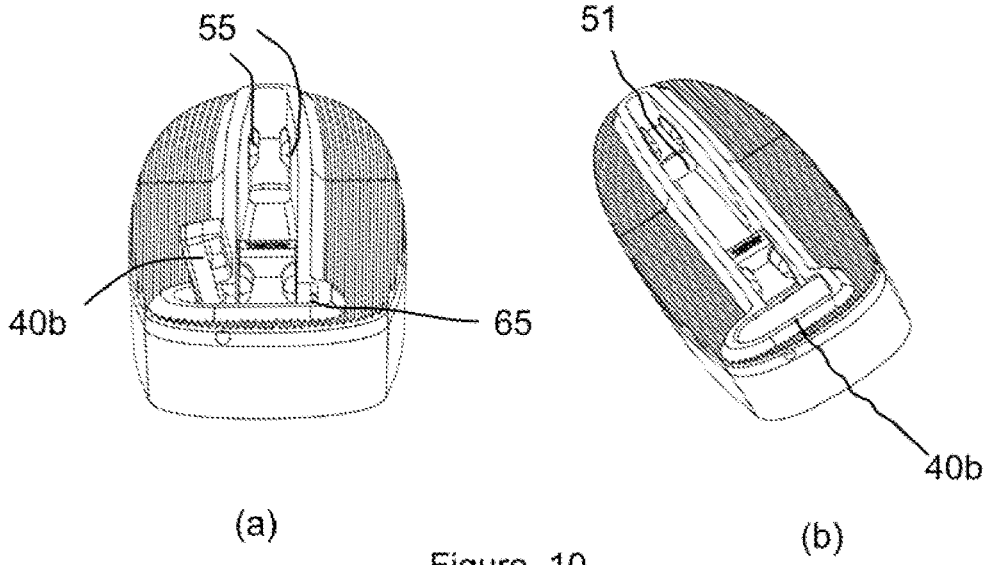
FIG. 10 shows another embodiment of the mounting box with a magnetic locking tab with the tab in the (a) open position and (b) locking position.
Figure 11:
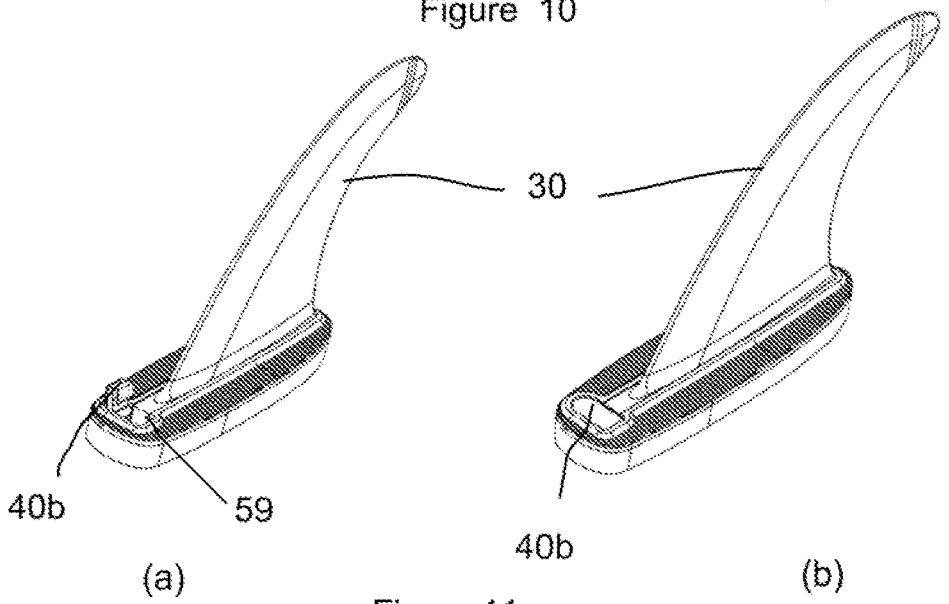
FIG. 11 shows the locking tab of FIG. 10 with the fin mounted thereto with the magnetic locking tab with the tab in the (a) open position and (b) locking position, FIG. 12 (*a*) and (*b*) show two embodiments of the magnetic locking tab, FIG. 13 (*a*) to (*d*) shows different design/weigh saving cavities formed in the fin base.
Figure 12:
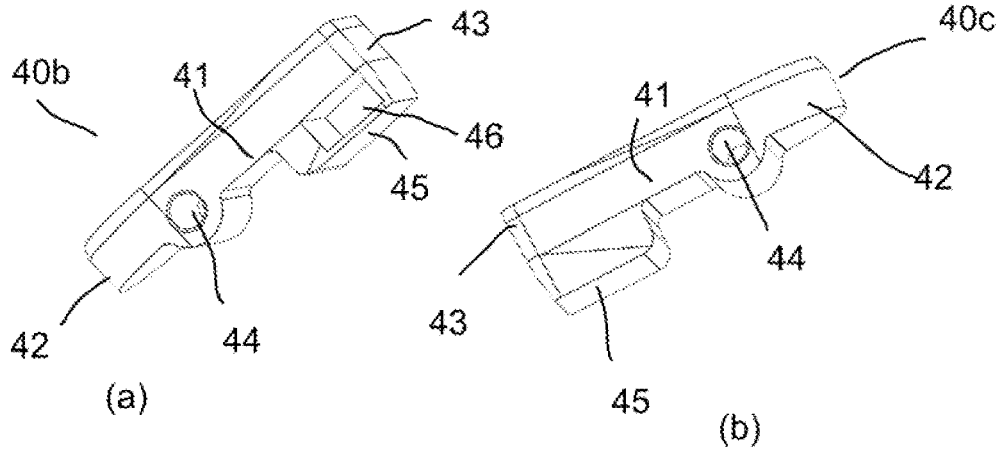

FIGS. 10 to 12 show a modified embodiment having a magnetic locking engagement means between the locking tab 40 and the mounting box 20. The locking tab 40*a* in this embodiment similarly comprises a body 41 with a proximal end 42 and a distal end 43. The body 41 includes mount apertures 44 extending between opposing side walls thereof adjacent but spaced from the proximal end 42 and a magnetic formation 45 at the distal end 43 thereof.

The mount apertures 44 receive the pivot protrusions 62 of the lock section 52, and the magnetic formation 45 engages a corresponding magnetic engagement 65 in the lock section 52. Alternatively, a mount pin can extend through the mount aperture 44, with the mount pin received in corresponding openings in the mounting box 20 to provide the secure pivotable mount for the locking tab 40.

The magnetic formation 45 and the corresponding magnetic engagement 65 can be any suitable magnetic engagement means therebetween, such as opposite pole magnets 45 and 65, a magnet 45 and a metal seat 65 of the mounting box 20, or a metal formation 45 to be received in a magnetic seat 65 of the mounting box 20. The magnetic engagement thus replaces the distal end protrusion means of the locking tab 40. FIG. 12(*a*) shows the magnetic formation 45 having a cavity 46 formed therein and FIG. 12(*b*) shows a locking tab 40 without the cavity 46.

Similar to the above, the locking tab 40 is pivotable by hand (use of a user's fingers pressing on the proximal end 42) to its unlock position, at which proximal end 42 is received in the lock section 52 and the locking tab 40 extends vertically at 90° or more such that it does not impede with the start entry 59 of the fin section 51 adjacent the first end 25. In the lock position, the pivotable locking tab closed at 0° and is held via the magnetic force to its closed position.

In another alternative embodiment, the protrusions and channels between the mounting box 20 and the fin base 31 can be reversed, in that the fin base 31 can have protrusions to be received in recesses or apertures in the mounting box 20.

FIG. 13 shows the additional weight saving or design cut-outs or cavities 39 that can be formed extending through the base 31 between the side walls 33. As shown in the example, the cavities 39 can be trapezoidal cavities 39*a*, circular cavities 39*b*, oval cavities 39*c*, rectangular cavities 39*d*, or other shape cross-section as desired. The cavities 39 extend in a direction perpendicular to the longitudinal direction of the base 31, spaced along the side walls 33, and are thus parallel to each other.

FIG. 14 shows another alternative embodiment where the fin base 31 includes spaced stainless steel pins 85*c* that extend out sidewardly therefrom which correspond to and will be received in channels 55*c* formed in the internal side walls 53 of the fin mounting box 20. As can be appreciated, this is a reverse of the embodiment above, where protrusions 85*c* extend from the fin base 31 (instead of recesses 85*a*, 85*b*), and channels 55*c* are formed in the mounting box 20 (instead of protrusions 55*a* and 55*b*).

FIG. 15 shows a modification of the mounting box 10*a* of FIG. 7 with the recess fin section 51 having parallel internal side walls 53 and still produce the same locking method via the corresponding protrusions and channels. FIG. 15 (*b*) show flutes or hydro dynamic contours 59 applied to the upper surface 22. The fin mounting box can be manufactured wider and longer to produce maximum adhesion to watercraft surface.

It is to be noted the locking tab does not have to be pivotably mounted to the mounting box, but can be press-fitted, slidable, threadably engaged like a threaded cap, and similar. The locking tab can be oriented and movable in any desired orientation such as parallel, lengthways or lateral to the channel.

Figure 16:
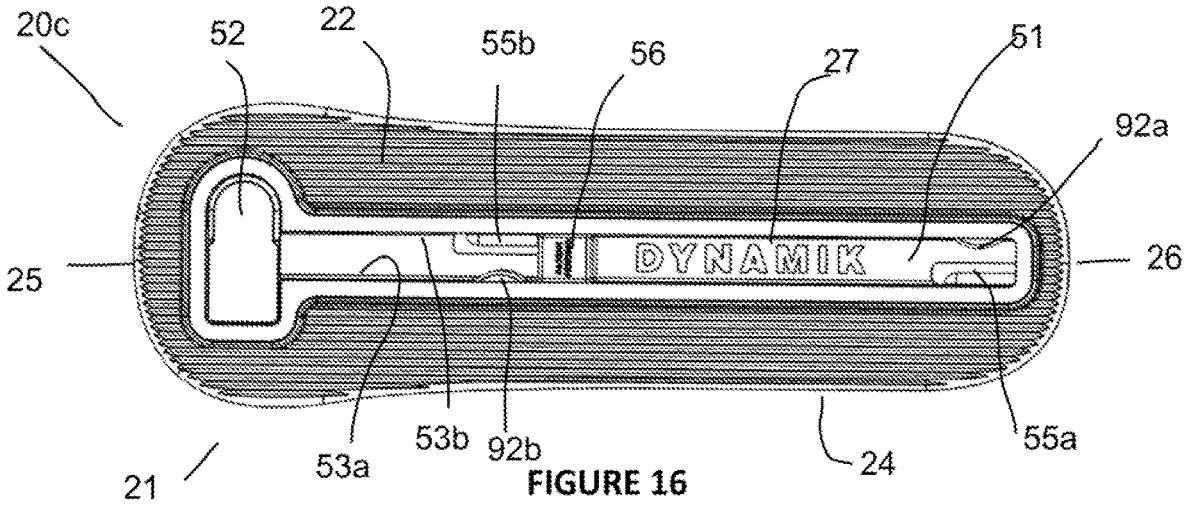
FIG. 16 is a top view of a mounting box according to another modified embodiment of the present invention.
Figure 17:
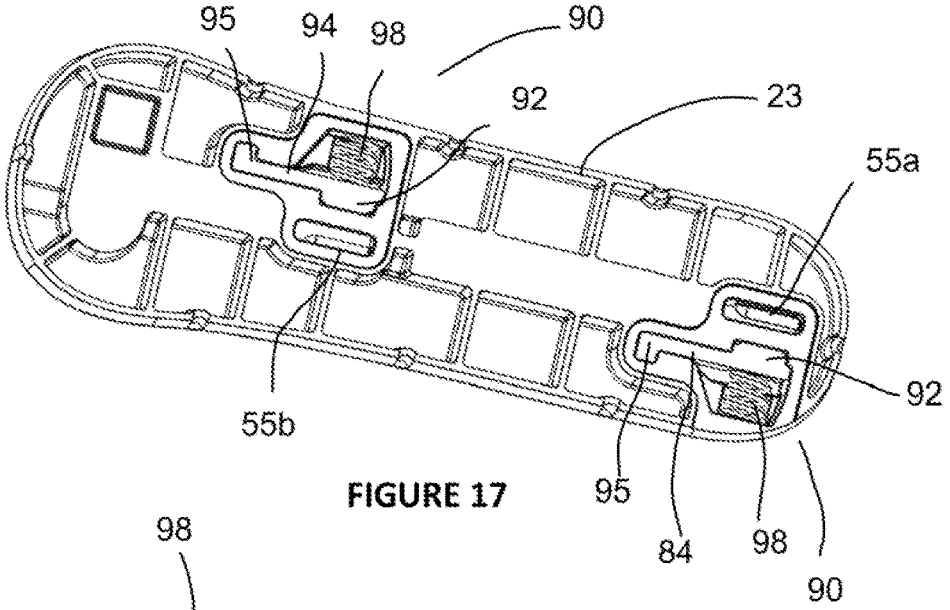
FIG. 17 is a bottom view of the mounting box of FIG. 16.
Figure 18:
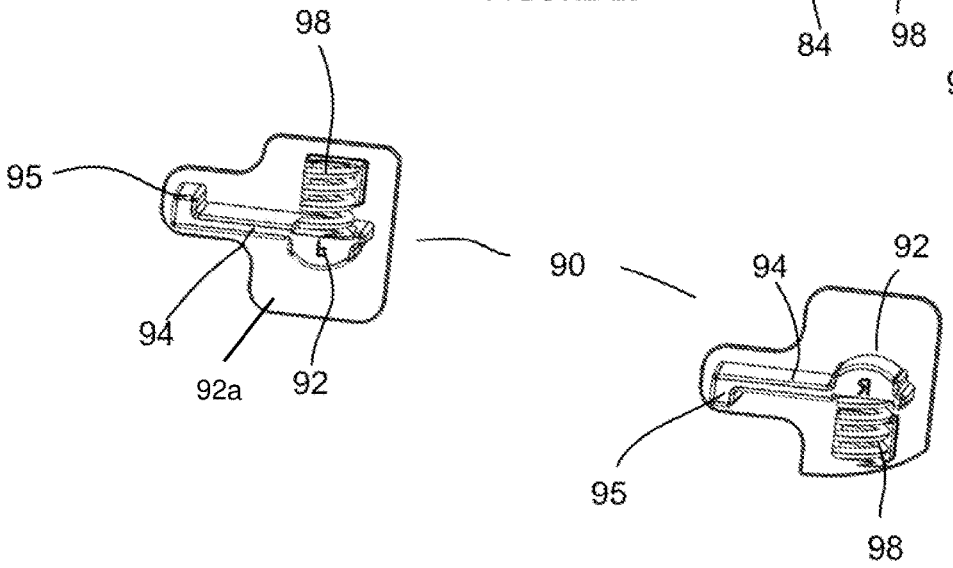
FIG. 18 shows the biasing tabs for the mounting box of FIG. 16.

FIGS. 16 and 17 show a mounting box 20*c* for an assembly 10*c* (FIG. 21) according to another modified embodiment of the present invention. The assembly 10*c* similarly comprises a mounting box 20*c*, a fin 30*c* and a locking tab 40.

The mounting box 20*c* is similar to the mounting box 20 described above and similar parts are referred with similar numbers. The mounting box 20*c* also comprises an elongated body 21 having the first (lower) surface 22, the opposite second (upper) surface 23, peripheral side edge 24, first (front) end 25 and second (rear) end 26.

The channel 27 is formed in the body 21 with the fin section 51 and the lock section 52. The fin section 51 is shaped for receiving a correspondingly shaped base 31 of the fin 30*c*. The fin section 51 of the channel 27 in this embodiment comprises generally parallel internal side walls 53*a* and 53*b*.

In contrast to the mounting box 20, the mounting box 20*c* has single retention protrusions 55 at two locations instead of a pair thereof. One first retention protrusion 55*a* is formed adjacent the second end 26 and one second retention protrusion 55*b* is formed at the mid-portion adjacent to the bridge protrusion 56. The first protrusion 55*a* is formed at one side wall 53*a* and the second protrusion 55*b* is formed at the opposite side wall 53*b*.

Opposite each protrusion 55*a* and 55*b* is a respective biasing tab 90. The biasing tab 90 comprises a button head 92 connected to a mounting arm 94 which extends laterally from the button head 92. A distal end of the mounting arm 94 comprises an end formation 95 which is mounted to the body 21, with the button head 92 disposed opposite its respective protrusion 55*a* or 55*b* but spaced therefrom. The mounting arm 94 provides a cantilever mounting such that the button head 92 is movable away from its respective protrusion 55*a* or 55*b*. A spring 98 is disposed behind each respective button head 92 to bias the button head 92 towards its respective protrusion 55*a* or 55*b*. Only the button head 92 extends via a respective opening in the internal side wall 53 into the channel 27. A gap is maintained between the button head 92 and its respective protrusion 55*a*/55*b* even with the force of the biasing spring 98. The end formation 95 assists with maintaining the mounting orientation of the button head 92.

Each pair of protrusion 55 and button head 92 forms a fin retention means for the mounting box 20. The biasing force of the spring 98 can be chosen to provide the desired force to the button head 92 and thus the squeezing force to the fin base 31 in use.

The lock section 52 of the channel 27 is similar and is shaped to receive the locking tab 40 therein and provide pivotal mounting of the locking tab 40 as well as to lock the locking tab 40 therewithin.

Figure 19:
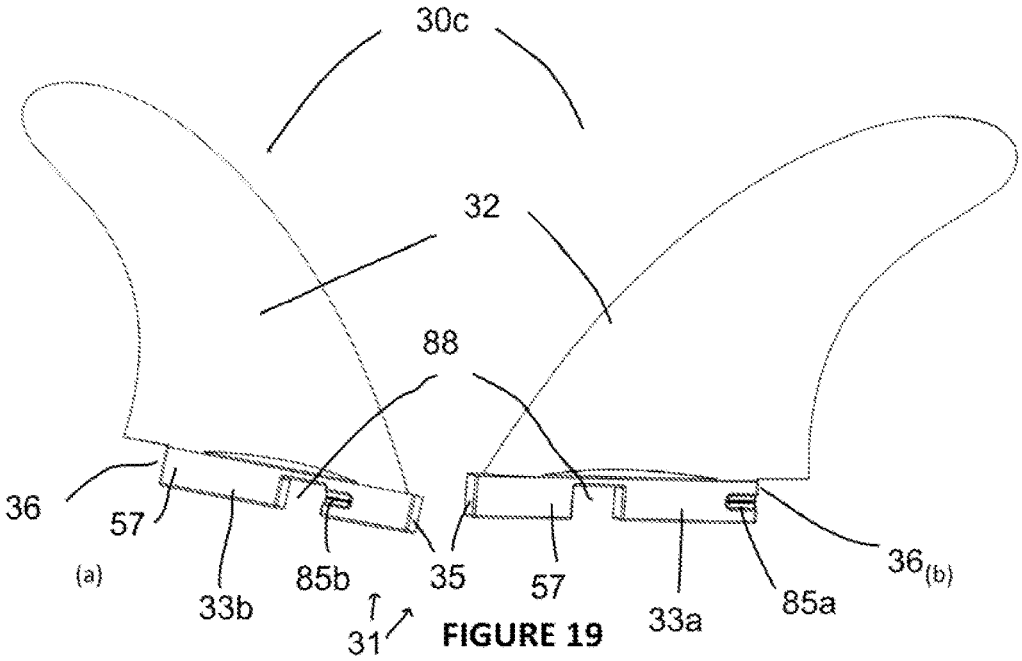
FIG. 19 shows (a) right side and (b) left side of a fin with a correspondingly shaped base for the mounting box of FIG. 16.

Referring to FIG. 19, the fin 30*c* comprises a base 31 and a shaped body 32. The base 31 is shaped and dimensioned to correspond to and be received in the fin section 51 of the mounting box channel 27. The base 31 is thus shaped to be elongated and rectangular from a first end 35 to a second end 36 thereof and have parallel external side walls 33 corresponding to the internal side walls 53 of the fin section 51. The base 31 is shorter and terminates spaced from the rear edge of the fin shaped body 32.

The base 31 comprises recesses 85 which correspond to the protrusions 55 of the fin section 51. The recesses 85 in this embodiment are thus a single recess only at each location. The recesses comprise a first recess 85*a* formed adjacent the second end 36 and a second recess 85*b* formed at the mid-portion adjacent the cavity 88 which receives the bridge protrusion 56. The recesses 85 are formed into the side walls 33 at opposite sides thereof. At the opposite side of each recess 85, the side wall 53 at locations 57 does not have any recesses and provides a flat wall surface for the button head 92.

The locking tab 40 in this embodiment is similar and can be any of the embodiments described above.

Figure 20:
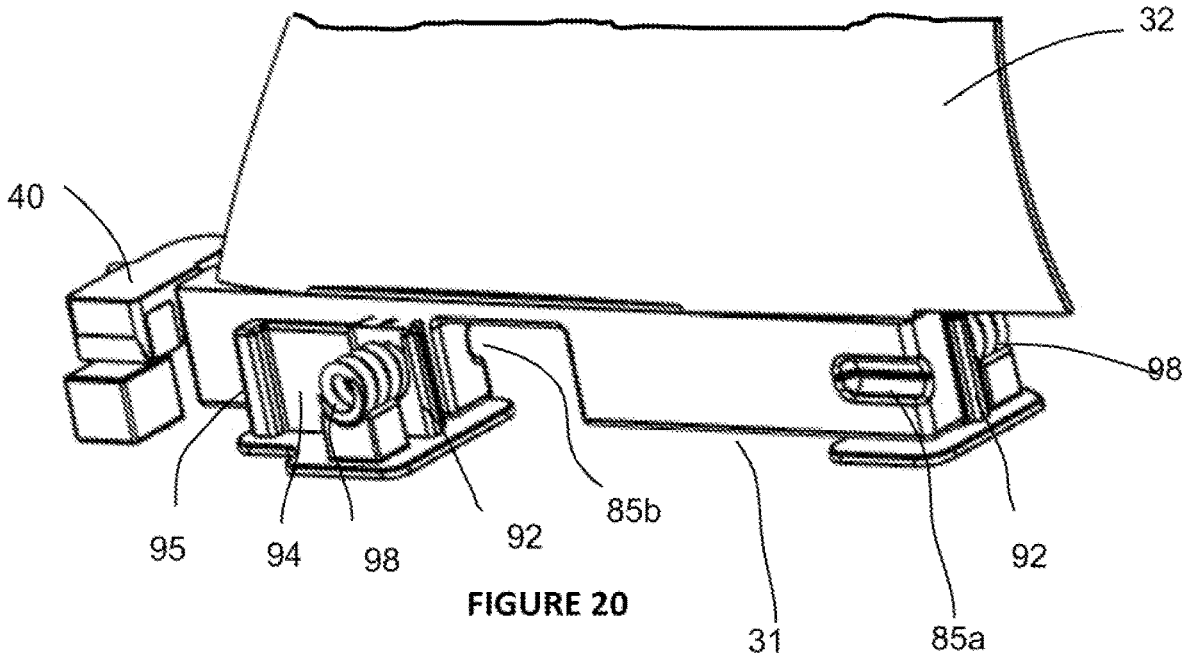
FIG. 20 is an enlarged view of the base of the fin of the FIG. 19 engaged by the biasing tabs in use.

FIG. 20 is an enlarged view of the base 31 of the fin 30*c* engaged by the biasing tabs 90 in use. The side wall 53 at locations 57 are engaged by the button heads 92, whilst the protrusions 55 are inserted into the recesses 85. The biasing tabs 90 thus provides a biased fitted engagement of the base 31.

Figure 21:
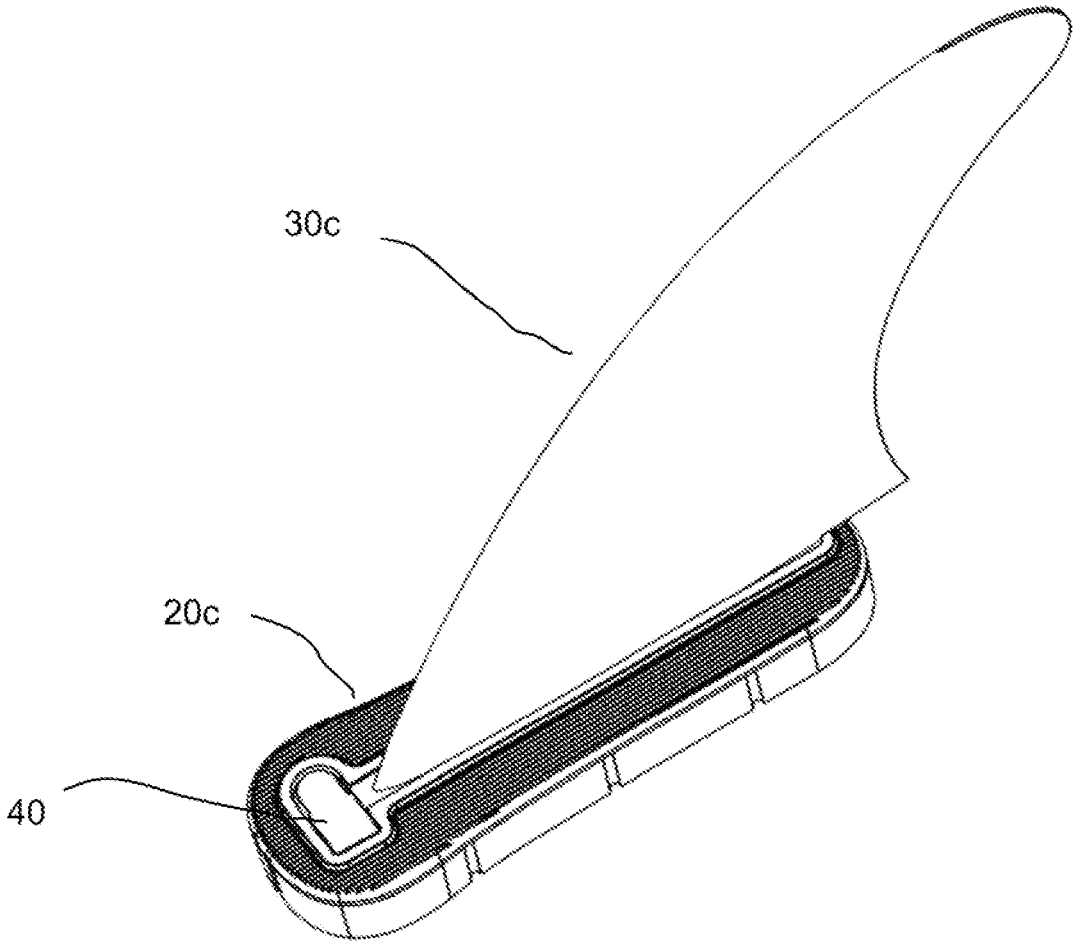
FIG. 21 is a perspective view of the fin mounted to the mounting box.

FIG. 21 is a perspective view of the fin 30*c* mounted to the mounting box 20*c* with the locking tab 40 in the closed locked position thereof.

Modifications can be made to the embodiment above. For example, the biasing tab 90 can be a hollow button receiving the spring 98 and not have the mounting arm 94. Also, the locations 57 can have a recess therein and the button head shaped to be inserted into such a recess.

The retaining means can alternatively comprise the pairs of protrusions 55 such as that shown in FIGS. 1 to 4, FIGS. 9 and 10, with each of the protrusions 55 being movable and biased (e.g., via a spring) towards the fin base. The fin base will remain having the grooves 85. The biased movable pairs of protrusions 55 will provide a squeezing force to the fin base.

The invention in the preferred embodiment thus provides an assembly comprising a fin 30 and a fin mounting box 20*c* for a water sports board, wherein:

- the mounting box 20*c* is adapted to be mounted to the board, the mounting box having an outwardly facing channel 27 formed therein,
- the fin comprises a fin base 31 and a body 32 extending from the fin base, the fin base being shaped to be received in the channel,
- the channel comprises channel engagement formations 55/92 and the fin base comprises corresponding fin base engagement formations 85/57 which engage the channel engagement formations when the fin base is inserted into the channel to retain the fin to the mounting box, and
- the assembly includes a locking tab 40 received in the channel to prevent movement of the fin base in the channel and disengagement of the corresponding channel and fin base engagement formations.

In the preferred embodiment, the mounting box comprises an elongated body 21 having a first end 25 and a second end 26, the channel being formed in the body to extend from the first end to the second end, and the channel comprises a fin section 51 and a lock section 52, the lock section being disposed adjacent the first end and the fin section extending from the lock section towards the second end, the fin section adapted to receive the fin base and the lock section adapted to receive the locking tab.

In the preferred embodiment, the channel engagement formations comprises:

- at least one retention means pair of a retention protrusion 55 extending from an internal side wall 53*a* of the mounting box channel 27 and a biased button head 92 extending from an opposite facing internal side wall 53*b* of the mounting box channel, the biased button head disposed opposite to and spaced from the retention protrusion.

In the preferred embodiment, the channel engagement formations comprises two pairs of retention means, a first pair being adjacent the second (rear) end 26 and a second pair being at a mid-portion of the channel 27.

In the preferred embodiment, the button head 92 of the first pair of retention means is disposed on a first internal side wall 53*b* and the button head 92 of the second pair of retention means is disposed on an opposite second internal side wall 53*a*.

In the preferred embodiment, each button head 92 comprises a button head body 92*a*, a mounting arm 94 which extends laterally from the button head body, a distal end 95 of the mounting arm is mounted to the mounting box to provide a cantilever mounting for the button head body, and a biasing spring 98 is disposed behind the button head body to bias the button head.

In the preferred embodiment, 3 wherein each button head 92 extends via an opening in the internal side wall 53 into the channel 27.

In the preferred embodiment, the fin base engagement means comprises a respective recess 85 in a side wall 33 of the fin base 31 to receive each retention protrusion 55 of the mounting box channel 27, and at the opposite side wall 33 of the fin base 31 to each recess 85, the side wall 33 of the fin base does not have any recesses and provides a flat wall surface 57 for the button heads 92.

In the preferred embodiment, the fin base comprises a first recess 85*a* in a side wall 33*a* of the fin base 31 formed adjacent the second end 26 and a second recess 85*b* formed in an opposite side wall 33*b* of the fin base 31 at a mid-portion thereof.

In the preferred embodiment, the fin base 31 is moved in the rearward longitudinal direction to engage the fin base engagement formations 85, 57 with the channel engagement formations 55, 92, and the fin base 31 is moved in the forward longitudinal direction to disengage the fin base engagement formations from the channel engagement formations.

In the preferred embodiment, the locking tab 40 is pivotable between a lock position and an unlock position, wherein in the lock position the locking tab prevents movement of the fin base 31 within the channel 27 and in the unlock position the fin base can be removed from the channel.

In the preferred embodiment, the lock section is dimensioned and disposed such that the locking tab in the lock position thereof extends fully across and covers a start entry of the fin section.

In the preferred embodiment, the lock section 52 comprises a pivot portion 61 with pivot protrusions 62 to provide pivotal mounting of the locking tab 40 between lock and unlock positions thereof, and a retention portion 64 with retention protrusions 65 or a retention magnet 65 for locking the locking tab in the closed position thereof.

In the preferred embodiment, the pivot protrusions are disposed close to the start entry 59 of the fin section 51 such that a proximal end 42 of the locking tab 41 can be pushed into the pivot portion 61 to move the locking tab into the unlock position thereof.

In the preferred embodiment, the locking tab 40 urges the fin base 31 to where the corresponding engagement means engage each other in the lock position thereof. For example, the locking tab 40 can have a tapered surface which engages the front end of the fin base as it moves to its lock position to provide the urging force.

In another embodiment, the mounting box 20*a* is adapted to be mounted onto the lower surface of the board where it extends from the lower surface of the board, the mounting box comprising a body having a flat upper surface 23 to be attached to the surface of the watercraft board and a lower surface 22 which is bulbous convex shaped and extending from the lower surface.

In another embodiment, the channel engagement formations comprise retention protrusions 55 extending from facing internal side walls 33 of the mounting box channel 27 and the corresponding fin base engagement formations comprises grooves 85 formed in the fin base 31, the protrusions shaped to be received in the corresponding grooves in the fin base.

In this embodiment, the protrusions 55*a* comprise a first pair of protrusions formed adjacent the second end 26 and a second pair of protrusions 55*b* formed at a mid-portion of the channel of the fin section, and the fin base comprises a first pair of grooves 85*a* formed adjacent the second end and a second pair of grooves 85*b* formed at a mid-portion thereof.

In another aspect, the invention provides a removable fin 30*c* for a fin mounting box 20*c* of a sports board, the mounting box having an outwardly facing channel 27 formed therein which comprises channel engagement formations, the channel engagement formations comprising:

at least one retention means pair of a retention protrusion 55 extending from an internal side wall 53*a* of the mounting box channel and a biased button head 92 extending from an opposite facing internal side wall 53*b* of the mounting box channel, the biased button head 92 disposed opposite to and spaced from the retention protrusion, the fin 20*c* comprising a fin base 31 and a body 32 extending from the base, wherein the fin base comprises engagement means being a respective recess 85 in a side wall 33*a* of the fin base to receive each retention protrusion of the mounting box channel, and at an opposite side wall 33*b* of the fin base to each recess, the side wall 33*b* of the fin base does not have any recesses and provides a flat wall surface for the button heads.

In a preferred embodiment, the channel engagement formations comprise two pairs of retention means, a first pair 55*a*, 92*a* being adjacent the second end 26 and a second pair 55*b*, 92*b* being at a mid-portion of the channel 27, with the retention protrusion 55*b* and the biased button head 92*b*, of the second pair being on respective opposite internal walls 53*a*, 53*b* to the retention protrusion and the biased button head of the first pair, the fin base 31 comprising a first recess 85*a* in a side wall 33*a* of the fin base 31 formed adjacent a rear end thereof and a second recess 85*b* formed in an opposite side wall 33*b* of the fin base at a mid-portion thereof.

The invention claimed is:

1. A fin mount assembly, comprising:

a fin: and a fin mounting box for a water sports board, wherein the mounting box is adapted to be mounted to the board, the mounting box having an outwardly facing channel formed therein, wherein said fin comprises a fin base and a body extending from the fin base, the fin base being shaped to be received in the channel, and wherein the channel comprises channel engagement formations and the fin base comprises corresponding fin base engagement formations in engagement with said channel engagement formations when the fin base is inserted into the channel so as to retain the fin in the mounting box; and a locking tab received in the channel to prevent movement of the fin base in the channel and disengagement of the corresponding channel and fin base engagement formations, wherein the mounting box comprises an elongated body having a first end and a second end, the channel being formed in the body to extend from the first end to the second end, wherein the channel comprises a fin section and a lock section, the lock section being disposed adjacent the first end and the fin section extending from the lock section towards the second end, the fin section adapted to receive the fin base and the lock section adapted to receive the locking tab, wherein the channel engagement formations are comprised of at least one retention means being comprised of at least one pair of protrusions, a first protrusion of said at least one pair of protrusions being comprised of at least one retention protrusion extending from an internal side wall of the mounting box channel, a second protrusion of said at least one pair of protrusions being comprised of at least one biased button head extending from an opposite facing internal side wall of the mounting box channel, said at least one biased button head disposed opposite to and spaced from said at least one retention protrusion, wherein the fin base engagement formations are comprised of a respective first recess configured to receive said at least one retention protrusion, said respective first recess being in a side wall of said fin base, and a respective first flat wall surface configured to engage said at least one biased button head, said respective first flat wall surface being in an opposite side wall of said fin base.

2. The fin mount assembly of claim 1, wherein the channel engagement formations are further comprised of another retention means, said another retention means being comprised of another pair of protrusions, said at least one pair of protrusions being adjacent the second end, and said another pair of protrusions being at a mid-portion of the channel.

3. The fin mount assembly of claim 2, wherein said at least one biased button head is disposed on a first internal side wall of the channel, wherein another first protrusion of said another pair of protrusions is comprised of another retention protrusion extending from another internal side wall of the mounting box channel, wherein another second protrusion of said another pair of protrusions is comprised of another biased button head extending from another opposite facing internal side wall of the mounting box channel, said another biased button head disposed opposite to and spaced from said another retention protrusion, and wherein said another biased button head is disposed on a second internal side wall of the channel, said first internal side wall of the channel being opposite said second internal side wall of the channel.

4. The fin mount assembly of claim 1, wherein said at least one biased button head comprises:

a button head body;

a mounting arm being extendable laterally from said button head body, said mounting arm having a distal end mounted to the mounting box so as to provide a cantilever mounting for said button head body; and a biasing spring being disposed behind said button head body to bias said at least one biased button head.

5. The fin mount assembly of claim 1, wherein said at least one biased button head is extendable into the channel via an opening in said opposite facing internal side wall.

6. The fin mount assembly of claim 3, wherein the channel engagement formations are further comprised of another retention means, said another retention means being comprised of another pair of protrusions, said at least one pair of protrusions being adjacent the second end, and said another pair of protrusions being at a mid-portion of the channel, wherein the fin base engagement formation is further comprised of a respective second recess configured to receive said another retention protrusion, and a respective second flat wall surface configured to engage said another biased button head, wherein said respective first recess and said respective first flat wall surface corresponds to said at least one pair of protrusions being adjacent the second end, and wherein said respective second recess and said respective second flat wall surface corresponds to said another pair of protrusions being at said mid-portion of the channel.

7. The fin mount assembly of claim 1, wherein the fin base is movable in a rearward longitudinal direction so as to engage the fin base engagement formations with the channel engagement formations, and wherein the fin base is movable in a forward longitudinal direction to disengage the fin base engagement formations from the channel engagement formations.

8. The fin mount assembly of claim 1, wherein said locking tab is pivotable between a lock position and an unlock position, said fin base being held within the channel in said lock position, said fin base being removable from the channel in said unlock position.

9. The fin mount assembly of claim 8, wherein said locking tab in said lock position is extended within the lock section and across a start entry of the fin section so as to cover said start entry.

10. A fin mount assembly, comprising:

a fin; and a fin mounting box for a water sports board, wherein the mounting box is adapted to be mounted to the board, the mounting box having an outwardly facing channel formed therein, wherein said fin comprises a fin base and a body extending from the fin base, the fin base being shaped to be received in the channel, and wherein the channel comprises channel engagement formations and the fin base comprises corresponding fin base engagement formations in engagement with said channel engagement formations when the fin base is inserted into the channel so as to retain the fin in the mounting box; and a locking tab received in the channel to prevent movement of the fin base in the channel and disengagement of the corresponding channel and fin base engagement formations, wherein the mounting box comprises an elongated body having a first end and a second end, the channel being formed in the body to extend from the first end to the second end, wherein the channel comprises a fin section and a lock section, the lock section being disposed adjacent the first end and the fin section extending from the lock section towards the second end, the fin section adapted to receive the fin base and the lock section adapted to receive the locking tab, wherein said locking tab is pivotable between a lock position and an unlock position, said fin base being held within the channel in said lock position, said fin base being removable from the channel in said unlock position, wherein the lock section comprises:

a pivot portion with pivot protrusions pivotal mounting engagement with said locking tab so as to pivotable between said lock position and said unlock position; and a lock section retention portion with lock section retention protrusions or a lock section retention magnet so as to hold said locking tab in said lock position.

11. The fin mount assembly of claim 10, wherein said pivot protrusions are disposed close to the start entry of the fin section so as to push a proximal end of the locking tab into pivot portion, said locking tab being in said unlock position.

12. The fin mount assembly of claim 8, wherein said locking tab in said lock position corresponds to the fin base engagement formations in engagement with said channel engagement formations when the fin base is inserted into the channel.

13. The fin mount assembly of claim 1, wherein the mounting box comprises a body having a flat upper surface so as to be mountable to a lower surface of a watercraft board and a lower surface with a bulbous convex shape extending from the lower surface.

14. The fin mount assembly of claim 10, wherein the channel engagement formations are comprised of retention protrusions extending from facing internal side walls of the mounting box channel, and wherein the fin base engagement formations are comprised of grooves formed in the fin base, said retention protrusions being receivable in corresponding grooves in the fin base.

15. The fin mount assembly of claim 14, wherein said protrusions are comprised of a first pair of protrusions formed adjacent the second end and a second pair of protrusions formed at a mid-portion of the channel of the fin section, and wherein the fin base is comprised of a first pair of grooves formed adjacent the second end and a second pair of grooves formed at a mid-portion thereof.

16. A removable fin for a fin mounting box of a sports board, the mounting box having an outwardly facing channel formed therein which comprises channel engagement formations, the channel engagement formations comprising at least one retention means pair of a retention protrusion extending from an internal side wall of the mounting box channel and a biased button head extending from an opposite facing internal side wall of the mounting box channel, the biased button head disposed opposite to and spaced from the retention protrusion, the fin comprising:

a fin base; and a body extending from the base, wherein the fin base comprises engagement means being a respective recess in a side wall of the fin base to receive each retention protrusion of the mounting box channel, and at an opposite side wall of the fin base to each recess, the side wall of the fin base does not have any recesses and provides a flat wall surface for the button heads.

17. The fin of claim 16, wherein the channel engagement formations are comprised of two pairs of retention means, a first pair being adjacent the second end and a second pair being at a mid-portion of the channel, with the retention protrusion and the biased button head of the second pair being on respective opposite internal walls to the retention protrusion and the biased button head of the first pair, the fin base comprising a first recess in a side wall of the fin base formed adjacent a rear end thereof and a second recess formed in an opposite side wall of the fin base at a mid-portion thereof.

* * * * *